US006050078A

United States Patent [19]

Paschereit et al.

[11] Patent Number: 6,050,078

[45] Date of Patent: Apr. 18, 2000

[54] GAS TURBINE COMBUSTION CHAMBER WITH TWO STAGES AND ENHANCED ACOUSTIC PROPERTIES

[75] Inventors: Christian Oliver Paschereit, Baden; Wolfgang Polifke, Windisch; Thomas Sattelmayer, Mandach, all of Switzerland

[73] Assignee: ABB Research Ltd., Zurich, Switzerland

[21] Appl. No.: 08/965,865

[22] Filed: Nov. 7, 1997

[30] Foreign Application Priority Data

Nov. 29, 1996 [DE] Germany ..... 196 49 486

[51] Int. Cl.[7] ..... F23R 3/16

[52] U.S. Cl. ..... 60/39.02; 60/732; 60/725; 60/39.75

[58] Field of Search ..... 60/737, 748, 732, 60/733, 725, 39.02, 39.75; 431/8, 10, 353

[56] References Cited

U.S. PATENT DOCUMENTS

| | | | |
|---|---|---|---|
| 3,925,002 | 12/1975 | Verdouw | 60/737 |
| 4,265,615 | 5/1981 | Lohmann et al. | 60/748 |
| 4,420,929 | 12/1983 | Jorgensen et al. | 60/733 |
| 4,760,695 | 8/1988 | Brown et al. | 60/725 |
| 4,819,438 | 4/1989 | Schultz | 60/732 |
| 4,867,674 | 9/1989 | Keller et al. | 431/10 |
| 5,069,029 | 12/1991 | Kuroda et al. | 60/737 |
| 5,158,445 | 10/1992 | Khinkis | 431/10 |
| 5,577,378 | 11/1996 | Althaus et al. | 60/39.17 |
| 5,626,017 | 5/1997 | Sattelmayer | 60/737 |
| 5,735,126 | 4/1998 | Schulte-Werning | 60/732 |

FOREIGN PATENT DOCUMENTS

| | | |
|---|---|---|
| 0321809B1 | 6/1989 | European Pat. Off. . |
| 0704657A2 | 4/1996 | European Pat. Off. . |
| 2538512 | 3/1976 | Germany . |
| 3000672C2 | 7/1980 | Germany . |
| 4446541A1 | 6/1996 | Germany . |
| WO94/28357 | 12/1994 | WIPO . |

*Primary Examiner*—Ted Kim

*Attorney, Agent, or Firm*—Burns, Doane, Swecker & Mathis, L.L.P.

[57] ABSTRACT

In a combustion chamber, the hot gases are prepared sequentially via two stages (20, 40). Arranged at the end of the first stage (20) in the direction of flow is a cross-sectional constriction (30) via which the hot gases (21) prepared in the first stage (20) are passed over into the second stage (40). The Mach number at the outlet (31) of this cross-sectional constriction (30) corresponds to the area ratio of outlet area (A2) over inlet area (A1). This results in a low-reflection configuration in which low-frequency vibrations are absorbed to a significant extent. And acoustic energy reflected from the turbine is substantially reduced.

1 Claim, 1 Drawing Sheet

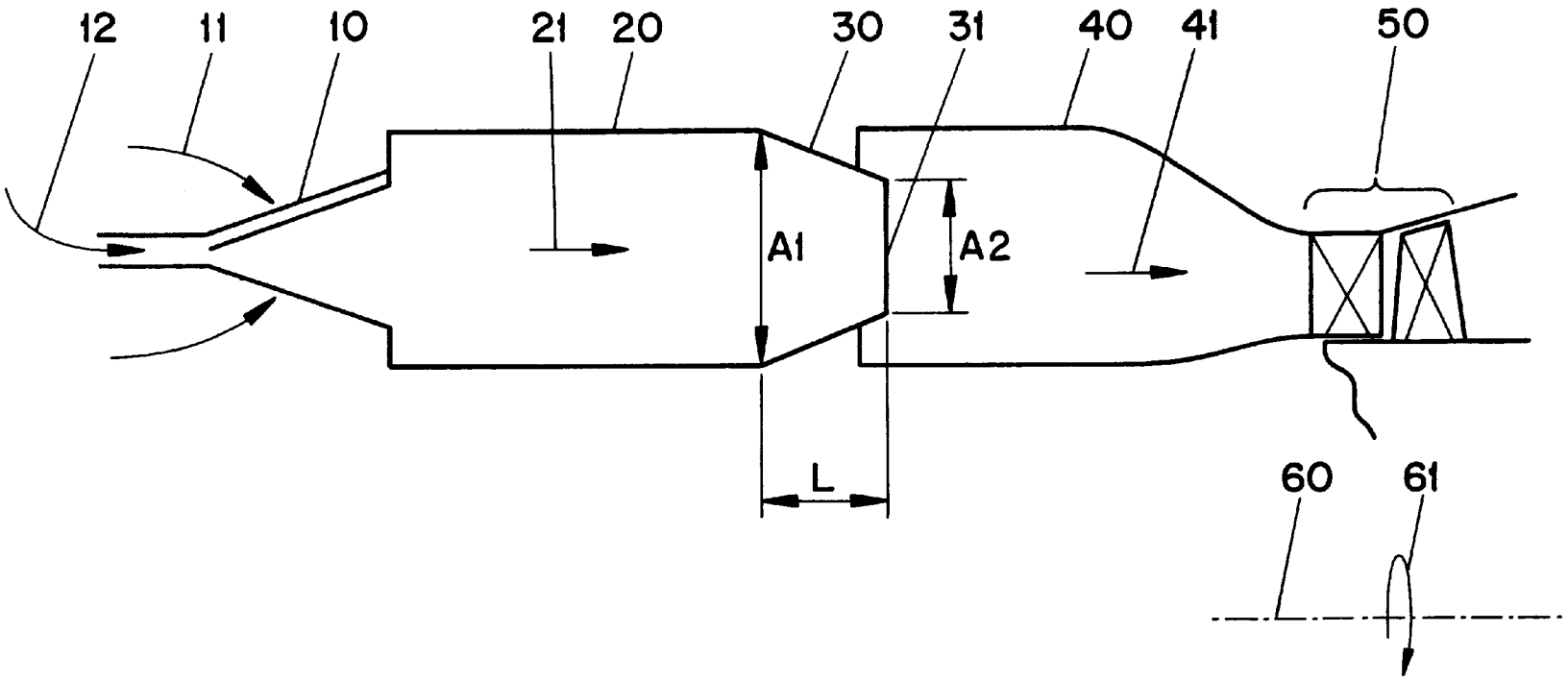
50
41
40
31
30
20
21
10
11
12
A2
A1
L
61
60

GAS TURBINE COMBUSTION CHAMBER WITH TWO STAGES AND ENHANCED ACOUSTIC PROPERTIES

BACKGROUND OF THE INVENTION

1. Field of the Invention

The present invention relates to a combustion chamber for supplying gases to drive a turbine.

2. Discussion of Background

The release of heat during the operation of combustion chambers, in particular in the case of premix combustion, causes pressure pulsations, the detrimental effect of which is especially well known to the person skilled in the art. In order to remedy this, various proposals have already been disclosed, the aim of which is to prevent the reflection of pressure pulsations, caused by the release of heat, at the combustion-chamber ends. Helmholtz resonators are often used in this connection.

Although Helmholtz resonators per se bring about a significant reduction in pressure pulsations during vibrations close to the design frequency, it must not be denied that, in addition to the disadvantage of the spatial conditions for such a device which are required for this, the effect in the vicinity of the design frequency is restricted.

In particular in the case of compact annular combustion chambers, such a device is difficult to use for reasons of space, so that there are still no suitable measures for preventing thermodynamic vibrations in combustion chambers of the newer generation or such measures have not yet been proposed in a suitable form.

SUMMARY OF THE INVENTION

Accordingly, one object of the invention, as defined in the claims, is to propose in the case of a combustion chamber of the type mentioned at the beginning a configuration which minimizes the reflection of pressure pulsations at the combustion-chamber end.

The essential advantage of the invention may be seen in the fact that, due to the low-reflection configuration of the combustion-chamber end, the feedback of pressure pulsations to the burner, which pressure pulsations may lead to renewed fluctuations in the release of heat and thus to renewed pressure fluctuations, is prevented.

The basic concept of the invention is based on the idea that low-frequency vibrations are absorbed to a significant extent if they are transmitted by a nozzle with subsequent free jet.

For acoustic reasons, the realization of the basic idea of the invention results in a combustion chamber having two stages arranged downstream in the direction of flow. Burners which may be of any type of construction per se are arranged at the head of the first stage. In view of the fact that combustion chambers of the newer generation are preferably operated with premix combustion for minimizing the pollutant emissions, premix burners are taken as a basis here for further consideration. Fuel and combustion air react with one another inside the first stage. The size of this first stage must be dimensioned in such a way that the heat from the combustion process is largely released before reaching the outlet of the first stage in the direction of flow. The CO burn-out, on the other hand, need not be complete. The reaction products from the combustion inside the first stage then flow through its outlet, which according to the invention is designed according to the following criteria described, and then pass into the second stage, which operates as a burn-out zone. The latter in turn must be dimensioned in such a way that the CO content drops to the desired value before the working gases are then admitted to the guide and moving blades of a downstream turbine.

According to the invention, the transition, in the case of a combustion chamber consisting of two stages, between the first and second stage is formed by a cross-sectional constriction at which the low-frequency vibrations are absorbed by the latter being transmitted through the said constriction, which is designed as a nozzle contraction, with subsequent free jet. The acoustic energy is therefore transferred into the energy of the fluctuating vortex intensity at the nozzle outlet. This energy is finally dissipated into heat.

If the combustion chamber is formed by more than two sequentially connected stages, the respective transitions of the individual stages, with regard to the cross-sectional constriction or nozzle contraction, are to be designed according to the principles established here for two stages.

A further essential advantage in the realization of the invention may be seen in the fact that the configuration of the cross-sectional constriction or nozzle contraction can always be adapted for minimum reflection in accordance with the predetermined combustion-chamber conditions without thereby changing the design of the combustion chamber. This end-side contraction of the first stage is preferably designed as a nozzle having a minimum pressure-loss factor or as a orifice having one or more openings. On the other hand, the cross-sectional run of the contraction in the direction of flow is delimited quite effectively according to the invention: the area ratio between outlet and inlet of the contraction corresponds to the Mach number at the nozzle outlet. The area ratio dealt with here will be explained in more detail further below.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein the single FIGURE shows a combustion chamber which is conceived as an annular combustion chamber and consists of two stages, a nozzle contraction acting intermediately between the two stages.

DESCRIPTION OF THE PREFERRED EMBODIMENT

Referring now to the drawing, wherein all elements not required for directly understanding the invention are omitted and the direction of flow of the media is indicated by arrows, the figure, as apparent from the shaft axis 60 and rotary motion 61 of the rotor (not shown in any more detail), shows that the combustion chamber here is an annular combustion chamber which essentially has the shape of a continuous, annular or quasi-annular cylinder. In addition, such a combustion chamber may also consist of a number of axially, quasi-axially or helically arranged and individually self-contained combustion spaces. The combustion chamber per se may also consist of a single tube. The annular combustion chamber shown in the figure consists of a first stage 20 and a second downstream stage 40. A cross-sectional constriction 30, which will be dealt with in more detail further below, acts intermediately between the two stages 20, 40. The first stage 20 first of all has on the head side a number of premix burners 10 arranged next to one another in the peripheral direction, the configuration and function of which is apparent from EP-0 321 809 B1, this publication being an integral part of the present description. A further premix burner, which is likewise predestined to be used here, is apparent from EP-0 704 657 A2, this publication also being an integral part of the present description. The mixture formation taking place in the burner 10 between an air flow 12 and a fuel 11 forms the combustion mixture which is burned in the first stage 20 to form hot gases 21. After flowing through the cross-sectional constriction 30 already mentioned, the hot gases 21 then flow into the second stage 40, in which the final burn-out takes place before the working gases 41 formed there are finally admitted to a downstream turbine 50.

The configuration of the cross-sectional constriction 30 is defined by the pressure-loss factor permitted and the requirements imposed on the flow zone. A nozzle form having a minimized pressure-loss factor or a orifice having one or more holes is possible. However, the area ratio of the contraction in the direction of flow is decisive for the configuration of the cross-sectional constriction 30. Minimum reflection is achieved if the Mach number at the outlet 31 of the cross-sectional constriction 30 is equal to the area ratio of the cross-sectional constriction 30, this area ratio being determined from the quotient between outlet area A2 divided by the inlet area A1 of the cross-sectional constriction 30. Minimum reflection is achieved by this specification, given a sufficient run of the nozzle contraction, i.e. the acoustic energy occurring there is transferred into the energy of the fluctuating vortex intensity at the outlet 31 of the cross-sectional constriction 30, this energy finally being dissipated into heat. An impedance $$\frac{z}{\rho_c} = 1,$$

which induces a typical reflection-free end at the outlet 31 of the cross-sectional constriction 30, is obtained solely by this geometric configuration of the cross-sectional constriction 30. Typical values for the residence times of the hot gases 21, 41 are 5–20 ms for the first stage and 10–50 ms for the second stage.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A process for operating a gas turbine comprising:

(a) supplying a combustion gas to a combustion chamber in a vortex flow pattern, the combustion chamber having a first stage and a second stage;

(b) directing the combustion gas from the second stage of the combustion chamber to a turbine;

(c) passing the combustion gas through a constriction between the first stage and the second stage, the constriction having an inlet cross-sectional area and an outlet cross-sectional area, wherein the constriction is a converging nozzle; and (d) supplying the combustion gas to the first stage at a flow rate such that a Mach number of the gas at the outlet of the constriction is equal to a ratio of the cross-sectional area of the outlet to the cross-sectional area of the inlet, whereby the acoustic energy reflected from the turbine is substantially reduced.

* * * * *